United States Patent [19]

Helle et al.

[11] Patent Number: 4,504,344

[45] Date of Patent: Mar. 12, 1985

[54] METHOD OF MANUFACTURING A STICK AND A STICK MANUFACTURED ACCORDING TO SAID METHOD

[76] Inventors: Antti Helle, Tunastigen 60, Luleå, Sweden, 951 58; Villhard Blomkvist, Nätgatan 10, Luleå, Sweden, 951 40

[21] Appl. No.: 459,644

[22] PCT Filed: May 4, 1982

[86] PCT No.: PCT/SE82/00148

§ 371 Date: Jan. 3, 1983

§ 102(e) Date: Jan. 3, 1983

[87] PCT Pub. No.: WO82/03789

PCT Pub. Date: Nov. 11, 1982

[51] Int. Cl.[3] ..... B32B 31/00

[52] U.S. Cl. ..... 156/185; 156/190; 156/252

[58] Field of Search ..... 156/185, 187, 188, 190–192, 156/195, 148–149, 252; 273/67 R, 67 A, 67 D, 73 F, DIG. 7, DIG. 23

[56] References Cited

U.S. PATENT DOCUMENTS

| | | | |
|---|---|---|---|
| 3,353,826 | 11/1967 | Traverse | 273/67 A |
| 3,855,031 | 12/1974 | McNeely | 156/190 |
| 4,013,288 | 3/1977 | Goverde | 273/67 A |
| 4,052,499 | 10/1977 | Goupil et al. | 273/67 A X |
| 4,059,269 | 11/1977 | Tiitola | 273/67 A |
| 4,124,208 | 11/1978 | Burns | 273/67 A |
| 4,180,413 | 12/1979 | Diederich | 156/190 X |

FOREIGN PATENT DOCUMENTS

| | | | |
|---|---|---|---|
| 2005952 | 10/1971 | Fed. Rep. of Germany | 273/67 A |

*Primary Examiner*—David Simmons

*Attorney, Agent, or Firm*—Cushman, Darby & Cushman

[57] ABSTRACT

This invention relates to a method of manufacturing a stick (1,1') and to a stick manufactured according to said method.

The object of the present invention is to propose a method for the manufacture of a stick, which substantially shall have the same properties as a conventional wood stick. The method according to the invention is characterized in that a core (4,4') of polyurethane foam is formed, that the foam is caused to cure, that a plurality of holes (7,7') are made in the blade portion (3,3'), that at least one longitudinal groove (5,5') is made in the handle portion (2,2'), that a reinforcement strip (8,8') of glass-fibre reinforced polyester is placed in the groove (5,5'), that a tape (9,9') of woven glass fabric is wound about the core (4,4'), that a hose (10,10') of woven glass fabric is threaded on the outside of the tape (9,9'), and that a surface layer of polyester plastic is applied on the core (4,4') with reinforcements.

4 Claims, 6 Drawing Figures

METHOD OF MANUFACTURING A STICK AND A STICK MANUFACTURED ACCORDING TO SAID METHOD

This invention relates to a method of manufacturing a stick, preferably for bandy or ice-hockey, and to a stick manufactured according to said method.

At present only bandy and ice-hockey sticks made of wood are used in practice. It is not only extremely difficult to procure the raw material (a special sort of wood), but these sticks, in addition, also are manufactured in a great variety of working moments, which are carried out manually. Such bandy and ice-hockey sticks, consequently, are extremely expensive to manufacture.

It was also tried to manufacture sticks, especially ice-hockey sticks, of synthetic materials, but they apparently did not compare favourably with the sticks made of wood, because they never got established on the market.

The present invention has the object to propose a method for the manufacture of a bandy or ice-hockey stick, which is extremely cheap to manufacture and, besides, has properties very similar to those of conventional wood sticks.

This object is realized by a method and a stick, which have been given the characterizing features defined in the attached claims.

Figure 1:
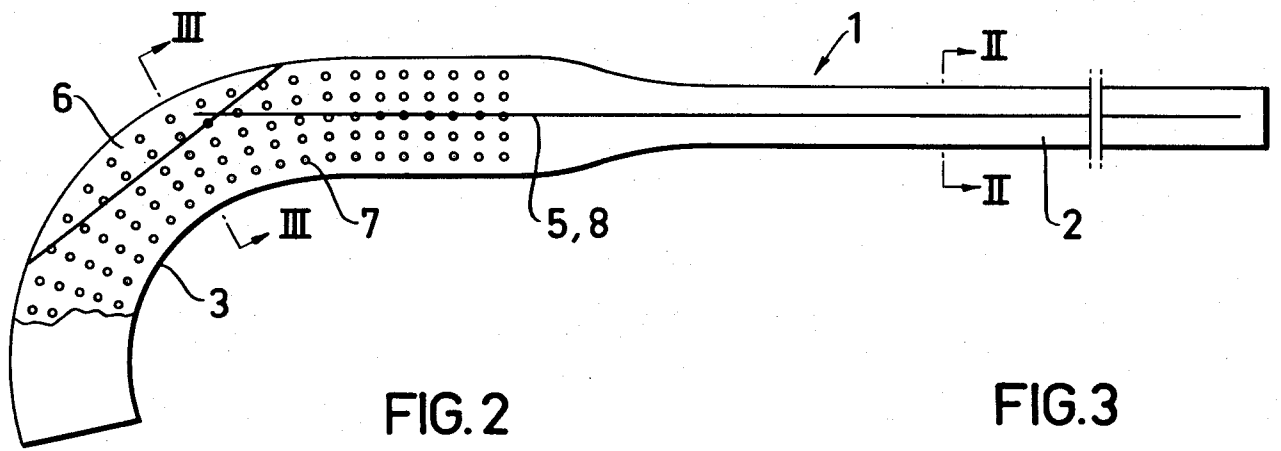
Figure 2:
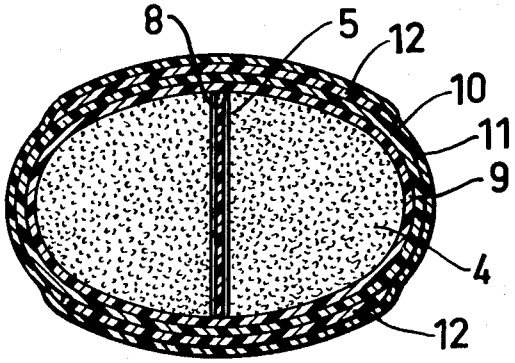
Figure 3:
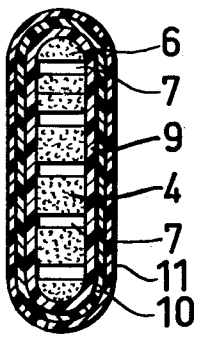
Figure 4:
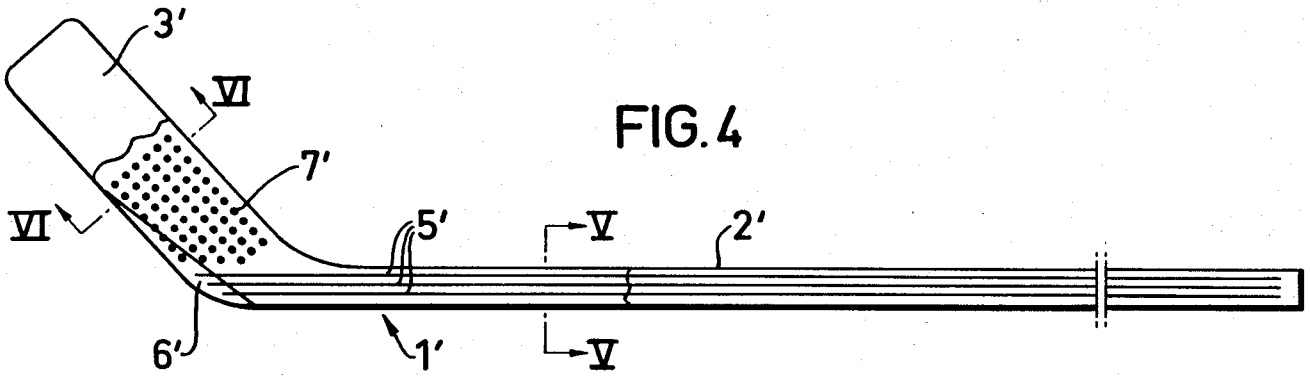
Figure 6:
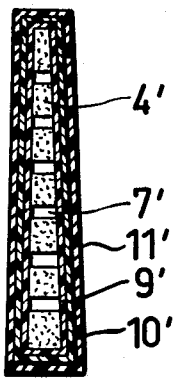
Figure 5:
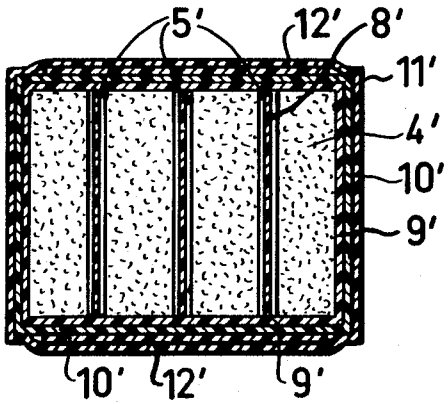

An embodiment of the invention is described in the following, with reference to the accompanying drawings, in which FIG. 1 is a schematic view of a bandy stick according to the invention, FIG. 2 is a section along II—II in FIG. 1, FIG. 3 is a section along III—III in FIG. 1, FIG. 4 is a schematic view of an ice-hockey stick according to the invention, FIG. 5 is a section along V—V in FIG. 4, and FIG. 6 is a section along VI—VI in FIG. 4.

The bandy stick shown in FIGS. 1–3 comprises a handle portion 2, which at one end transforms to a curved blade portion 3.

The bandy stick 1 is built up of a core 4 of polyurethane foam with a density of preferably 100–400 g/liter. In said core 4 a reinforcing strip 8, preferably of glass-fibre reinforced polyester, is attached. At the contact surface of the stick with the ice, furthermore, an additional reinforcing portion 6 of plastic sheet laminate or Teflon is located.

The first manufacturing step, i.e. the manufacture of the core 4, proceeds so that polyurethane foam is injected into a foam mould. The density of the core 4 can be varied by varying the amount of polyurethane foam injected into the mold.

Subsequent to the setting of the foam, the mould is removed, and the core 4 is ready.

A longitudinal groove 5 is now sawn into the core 4 so as to extend from the free end of the handle portion 2 to the region of the blade portion 3, into which a plurality of holes 7 are drilled.

Into said groove 5 a reinforcing strip 8 of glass-fibre reinforced polyester is laid, so-called one-way roving. The reinforcing strip 8 has a thickness smaller than the width of the groove 5, as shown in FIG. 2. The height of the strip 8 is equal to the height of the groove 5.

The manufacturing process continues in that a tape 9 of directed glass fibre, so-called one-way roving, is wound about the core 4 from the free end of the blade portion 3 to the free end of the handle portion 2. The winding is made with some overlapping, which is greater in the blade portion 3 and adjoining part of the handle portion 2. The tape 9 retains the reinforcing strip 8 in place in the groove 5.

Over the outside of the tape 9 wound-on a hose 10 of diagonally woven glass fibre (roving 50—50) is drawn and extends all the way from the free end of the blade portion 3 to the free end of the handle portion 2. In this manufacturing phase the hose 10 has the object of keeping the tape 9 in place.

The core 4 with the groove 5, reinforcing strip 8, tape winding 9 and hose 10 is placed into an injection mould, into which polyester plastic is injected which thereby forms a surface layer 11 about the entire core 4. See FIGS. 2 and 3.

The polyester plastic also fills the holes 7 in the blade portion 3, whereby small staves of polyester plastic are formed which extend transversely through the blade portion 3 and reinforce the same.

Due to the thickness of the reinforcing strip 8 being smaller than the width of the groove 5, the polyester plastic penetrates into the groove 5 and encloses the strip 8 on its two sides.

The polyester plastic also penetrates into the hose 10 and tape winding 9 all the way inward to the core 4.

Subsequent to the setting and mould removal, the stick is ground smooth and varnished.

When a bandy stick is to be manufactured which meets very high strength requirements, glass fibre tapes 12 of directed type (roving 50—50) are applied on the sides of greater planeness of the handle portion 2 on the outside of the hose 10 before the core 4 with reinforcements is positioned in the injection mould.

The ice-hockey stick 1′ shown in FIGS. 4–6 is built up according to the same principle as the bandy stick 1 is shown in FIGS. 1–3. The ice-hockey stick 1′ comprises a handle portion 2′ and a blade portion 3′.

In a manner corresponding to that for the bandy stick, a core 4′ is injection moulded. The stick, thus, can have different density and thereby vary in weight.

In the foam mould a reinforcing portion 6′ is attached which, thus, is integrated with the core 4′.

As appears from FIGS. 4 and 5, the handle portion 2′ of the ice-hockey stick 1′ is provided with three reinforcing strips 8′ of glass-fibre reinforced polyester. This implies that three grooves 5′ must be arranged. The strips 8′ have a thickness smaller than the width of the grooves 5′.

The blade portion 3′ is provided with a plurality of holes 7′, preferably with a diameter of 3 mm.

In a manner corresponding to that for the bandy stick, a tape 9′ of directed glass fibre is wound about the core 4′ along the entire length thereof. Overlapping is applied which is greatest in the region of the blade portion 3′ and adjacent part of the handle portion 2′.

Over the outside of the tape winding 9′ a hose 10′ of roving (90–10) is drawn and extends from the tip of the blade portion 3′ to the free end of the handle portion 2′.

The core 4′ with reinforcements is positioned in an injection mould whereafter polyester plastic is injected into the mould in a manner corresponding to that at the manufacture of the bandy stick.

After setting a surface layer 11′ of polyester plastic is formed which preferably has a thickness of about 1.5 mm. When a stick with extra rigid handle portion 2′ is desired, two additional reinforcing tapes 12' of roving (50—50) according to FIG. 5 are attached.

The manufacturing method described above renders it possible to manufacture, for example, bandy and ice-hockey sticks with desired weight distribution and strength properties. The density of the core 4,4', for example, can be varied, certain reinforcements, for example the tapes 12,12', can be abandoned, reinforcements with certain special properties can be used, and the number of reinforcements, for example of the strips 8,8', can be varied.

It is, of course, also possible to imagine the above method be applied to the manufacture of sticks for sports other than bandy and ice-hockey.

We claim:

1. A method of manufacturing sticks characterized in that a core of polyurethane foam is formed which includes a handle portion and a blade portion, that the foam is caused to set, that a plurality of holes are made in the blade portion, that at least one longitudinal groove is made in the handle portion, that a reinforcing strip is laid into the groove, that a tape of woven glass fabric is wound about the core, that a hose of woven glass fabric is drawn upon the core on the outside of the tape, that a layer of polyester plastic is applied about the entire core with its reinforcements, and that the polyester plastic is caused to set.

2. A method as in claim 1, characterized in that the polyester plastic fills the holes in the blade portion.

3. A method as in claim 1, characterized in that on the glass fibre hose, tape of woven glass fabric is applied in the region for the handle portion before the layer of polyester plastic is applied.

4. A method as in claim 1, characterized in that the tape is wound on with overlapping, which is greatest on the blade portion and adjoining part of the handle portion.

* * * * *

UNITED STATES PATENT AND TRADEMARK OFFICE

CERTIFICATE OF CORRECTION

PATENT NO. : 4,504,344

DATED : March 12, 1985

INVENTOR(S) : Antti Helle

It is certified that error appears in the above-identified patent and that said Letters Patent is hereby corrected as shown below:

On the title page Insert:

-- Foreign Application Priority Data

May 6, 1981 Sweden 8102836-7 --.

Signed and Sealed this

Twenty-third Day of May, 1989

*Attest:*

DONALD J. QUIGG

*Attesting Officer*

*Commissioner of Patents and Trademarks*